US010332503B1

(12) United States Patent
Kalama et al.

(10) Patent No.: US 10,332,503 B1
(45) Date of Patent: Jun. 25, 2019

(54) SYSTEM AND METHOD FOR ACTIVE SOUND COMPENSATION

(71) Applicant: Disney Enterprises, Inc., Burbank, CA (US)

(72) Inventors: Asa K. Kalama, Burbank, CA (US); Robert Scott Trowbridge, Burbank, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 0 days.

(21) Appl. No.: 16/147,475

(22) Filed: Sep. 28, 2018

Related U.S. Application Data

(60) Provisional application No. 62/610,862, filed on Dec. 27, 2017.

(51) Int. Cl.
*G10K 11/16* (2006.01)
*H04R 3/00* (2006.01)
*G10K 11/178* (2006.01)

(52) U.S. Cl.
CPC .. *G10K 11/17823* (2018.01); *G10K 11/17853* (2018.01); *G10K 2210/3028* (2013.01); *G10K 2210/3044* (2013.01)

(58) Field of Classification Search
CPC ..... G10K 11/178; G10K 11/1784; G10K 11/1788; G10K 11/17823; G10K 11/17853; G10K 2210/3028; G10K 2210/3044; H04R 3/00; H04R 3/005; H04R 29/00; H04R 27/00; H04R 2227/005; H04R 2227/007
See application file for complete search history.

(56) References Cited

U.S. PATENT DOCUMENTS

2007/0266395 A1* 11/2007 Lee ..... H04H 60/31 725/11
2008/0192945 A1* 8/2008 McConnell ..... H04M 9/082 381/66
2013/0230175 A1* 9/2013 Bech ..... H04S 7/30 381/17
2014/0380350 A1* 12/2014 Shankar ..... G06Q 30/0204 725/18
2015/0264507 A1* 9/2015 Francombe ..... H04S 7/301 381/303
2015/0319518 A1* 11/2015 Wilson ..... H04R 1/10 381/71.6

(Continued)

*Primary Examiner* — Thang V Tran
(74) *Attorney, Agent, or Firm* — Kilpatrick Townsend & Stockton LLP

(57) ABSTRACT

Systems and methods for active acoustic compensation in proximate theaters are disclosed herein. Such a system can include a first theater including a first content presentation system and a second theater including a second content presentation system. The system can include a processor in communicating connection with the first content presentation system and the second content presentation system. The processor can be controlled to: direct presentation of first content in the first theater via the first content presentation system; direct presentation of second content in the second theater via the second content presentation system; identify an impending first acoustic event in the first theater; and control the second content presentation system to generate a second acoustic event to mitigate the detectability of the first acoustic event in the second theater.

22 Claims, 6 Drawing Sheets

(56) References Cited

U.S. PATENT DOCUMENTS

2017/0236512 A1* 8/2017 Williams ..... G06F 16/68
381/79
2018/0018984 A1* 1/2018 Dickins ..... G10L 21/0205

* cited by examiner

SYSTEM AND METHOD FOR ACTIVE SOUND COMPENSATION

CROSS-REFERENCES TO RELATED APPLICATIONS

This application claims the benefit of U.S. Provisional Application No. 62/610,862, filed on Dec. 27, 2017, and entitled "SYSTEMS AND METHODS FOR ACTIVE SOUND COMPENSATION", the entirety of which is hereby incorporated by reference herein.

BACKGROUND

The present disclosure relates generally to the sound management in connection with content presentation. Sound forms a significant part of the enjoyment of content consumption. This is especially the case as relating to restricting or eliminating the perceptibility of sounds that do not originate from the content being consumed. In the case of theaters such as movie theaters, this can include attempts at soundproofing of the theater.

Soundproofing of a theater can be accomplished via a number of different techniques. These techniques can include, for example: building the theater as a room within a room to better acoustically isolate the theater; the inclusion of sound baffles along the walls and/or ceiling of the theater to reflect sound away from the walls and/or ceiling; and/or construction of the theater with specialized materials including, for example, soundproof drywall, soundproof insulation, and/or acoustic panels.

While these common soundproofing techniques can effectively dampen sound, they also present several drawbacks. Many of these techniques are bulky and take up significant amount of space. Further, these techniques may force certain appearances of the theater which may limit the creative ability of a theater designer to create a desired consumer experience. Further, these techniques are not always effective, especially for loud sounds. In light of these shortcomings in current soundproofing techniques for theaters, new systems and methods for active acoustic compensation in proximate theaters are desired.

BRIEF SUMMARY

Some embodiments of the present disclosure relate to audio-active noise cancellation or masking. Specifically, this can include the identification of a coming first acoustic event in a first theater, the determination of the effect of that acoustic event in a second theater, and the generation of second acoustic event in the second theater to mask or cancel the first acoustic event. This second acoustic event in the second theater can include a video portion or an audio portion, and this second acoustic event can be integrated into a plot or narrative of content presented in the second theater.

This second acoustic event can be selected and controlled according to one or several attributes of the first acoustic event including, for example, the magnitude of the first acoustic event including, for example, the amplitude of sound waves forming the first acoustic event, the frequency of some or all of the sound waves forming the first acoustic event, or the phase of some or all of the sound waves forming the first acoustic event. The second acoustic event can further, in some embodiments, be selected and controlled according to the attenuation of the first acoustic event before reaching the second theater. In some embodiments, data indicative of the one or several attributes of the first acoustic event can be modified by one or several values or parameters representative of sound attenuation between the first and second theaters. The second acoustic event can be selected and controlled according these one or several modified attributes of the first acoustic event.

One aspect of the present disclosure relates to a system for active acoustic compensation in proximate theaters. The system includes: a first theater having a first content presentation system; a second theater having a second content presentation system; and a processor in communicating connection with the first content presentation system and the second content presentation system. The processor can: direct presentation of first content in the first theater via the first content presentation system; direct presentation of second content in the second theater via the second content presentation system; identify an impending first acoustic event in the first theater, which first acoustic event has a level sufficient to be detectable in the second theater; and control the second content presentation system to generate a second acoustic event at least partially coinciding with the first acoustic event, which second acoustic event mitigates the detectability of the first acoustic event in the second theater.

In some embodiments, controlling the second content presentation system to generate a second acoustic event includes controlling the second content presentation system to generate a second visual event corresponding the second acoustic event. In some embodiments, the second acoustic event and the second visual event are integrated into a narrative formed by content presented before and after the second acoustic event and the second visual event. In some embodiments, the second acoustic event masks the first acoustic event. In some embodiments, the second acoustic event mitigates the first acoustic event via destructive cancellation.

In some embodiments, the processor can determine a magnitude of the second acoustic event. In some embodiments, determining the magnitude of second acoustic event includes: identifying the magnitude of the first acoustic event in the second theater; and matching the magnitude of the second acoustic event to the determined magnitude of the first acoustic event. In some embodiments, identifying the magnitude of the first acoustic event in the second theater includes: identifying an amplitude of the first acoustic event in the first theater; identifying transmission losses from the first theater to the second theater; and calculating the amplitude of the first acoustic event in the second theater based on the identified amplitude of the first acoustic event in the first theater and the transmission losses.

In some embodiments, identifying the amplitude of the first acoustic event in the first theater includes retrieving data for generating the first acoustic event from a memory. In some embodiments, the data characterizes the amplitude of the first acoustic event in the first theater. In some embodiments, determining the magnitude of second acoustic event includes: identifying an attribute of the first acoustic event in the second theater; and identifying a cancellation attribute for the second acoustic event in the second theater. In some embodiments, identifying the cancellation attribute includes: identifying at least one initial wave property of the first acoustic event in the first theater; identifying a filter value affecting acoustic transmission from the first theater to the second theater; and calculating at least one wave property of the first acoustic event in the second theater based on the at least one initial wave property and the filter value. In some embodiments, the at least one wave property includes at least one of: a frequency; a phase; and an amplitude.

One aspect of the present disclosure relates to a method for active acoustic compensation in proximate theaters. The method includes: directing presentation of first content in the first theater via the first content presentation system; directing presentation of second content in the second theater via the second content presentation system; identifying an impending first acoustic event in the first theater, which first acoustic event has a level sufficient to be detectable in the second theater; and controlling the second content presentation system to generate a second acoustic event at least partially coinciding with the first acoustic event, which second acoustic event mitigates the detectability of the first acoustic event in the second theater.

In some embodiments, the second acoustic event masks the first acoustic event. In some embodiments, directing presentation of second content in the second theater via the second content presentation system includes controlling the second content presentation system to present video and audio content forming a narrative. In some embodiments, controlling the second content presentation system to generate a second acoustic event includes controlling the second content presentation system to generate a second visual event corresponding the second acoustic event. In some embodiments, the second acoustic event and the second visual event generated are integrated into the narrative.

In some embodiments, the second acoustic event mitigates the first acoustic event via destructive cancellation. In some embodiments, the method includes determining a magnitude of the second acoustic event. In some embodiments, determining the magnitude of second acoustic event includes: identifying the magnitude of the first acoustic event in the second theater; and matching the magnitude of the second acoustic event to the determined magnitude of the first acoustic event. In some embodiments, identifying the magnitude of the first acoustic event in the second theater includes: identifying an amplitude of the first acoustic event in the first theater; identifying transmission losses from the first theater to the second theater; and calculating the amplitude of the first acoustic event in the second theater based on the identified amplitude of the first acoustic event in the first theater and the transmission losses.

In some embodiments, identifying the amplitude of the first acoustic event in the first theater comprises retrieving data for generating the first acoustic event from a memory. In some embodiments, the data characterizes the amplitude of the first acoustic event in the first theater. In some embodiments, determining the magnitude of second acoustic event includes: identifying an attribute of the first acoustic event in the second theater; and identifying a cancellation attribute for the second acoustic event in the second theater. In some embodiments, identifying the cancellation attribute includes: identifying at least one initial wave property of the first acoustic event in the first theater; identifying a filter value affecting acoustic transmission from the first theater to the second theater; and calculating at least one wave property of the first acoustic event in the second theater based on the at least one initial wave property and the filter value. In some embodiments, the at least one wave property includes at least one of: a frequency; a phase; and an amplitude.

DETAILED DESCRIPTION

The ensuing description provides illustrative embodiment(s) only and is not intended to limit the scope, applicability or configuration of the disclosure. Rather, the ensuing description of the illustrative embodiment(s) will provide those skilled in the art with an enabling description for implementing a preferred exemplary embodiment. It is understood that various changes can be made in the function and arrangement of elements without departing from the spirit and scope as set forth in the appended claims.

I. Introduction

Storytelling can occur in a number of locations and can be performed using a number of techniques. Modern storytelling includes the presentation of content, which can be digital content, to a content consumer. This content can include video content or audio content. Such storytelling can use sound in the form of character monologue or dialogue, sound effects corresponding to a depicted action or event such as, for example, the sound of an automobile engine accompanying video of an automobile race, and/or music. This sound can develop a plot of a storyline being conveyed, develop one or several characters, link events, or convey emotion. Aspects of the sound can be modified throughout the presentation of content to enhance storytelling. These modifications can include, changes to the volume, frequency, or tempo of generated sounds. In many instances, the conveyed sound can be very quiet, or can be very loud.

Storytelling can occur in a number of locations including within a movie theater, or on an amusement ride. In many instances, one or several theaters, which can include a room or area in which content is presented such as a movie theater or an amusement ride, may be proximate to each other such that some sound from one theater may travel to another theater. This travel of sound between theaters can adversely affect the experience of content consumers. In addition to this, an acoustic event, which can include either sound or vibrations can originate from a first theater and may travel to a second theater, adversely affecting the experience of content consumer in the second theater.

Traditionally, acoustics traveling between theaters, or specifically from a first theater to a second theater has been managed via passive measures. While these passive measures have provided some benefit, they have not been able to adequately address or eliminate this acoustic pollution. Active sound compensation addresses many of the shortcomings of traditional sound isolation techniques. The active acoustic compensation can include generating one or several acoustic events in the second theater. These one or several acoustic events in the second theater can mask sound traveling from the first theater or can eliminate that sound traveling from the first theater via destructive interference.

II. Active Acoustic Compensation System

Figure 1:
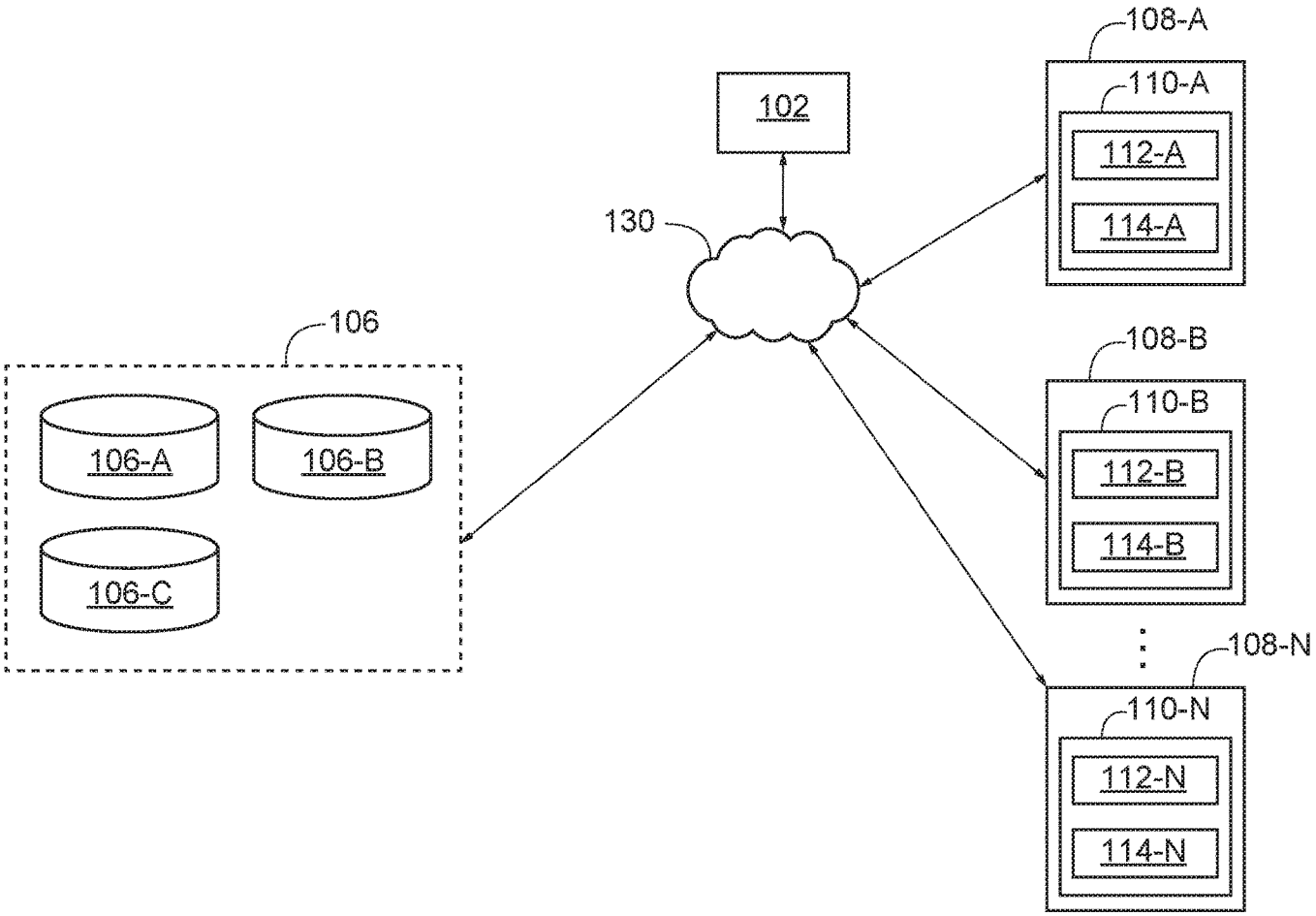
FIG. 1 is a schematic illustration of one embodiment of a system for active acoustic compensation in proximate theaters.

With reference now to FIG. 1, a schematic illustration of one embodiment of a system 100, also referred to herein as an active acoustic compensation system 100, for active acoustic compensation in proximate theaters is shown, which acoustic compensation can include sound compensation or vibration compensation. The system 100 can allow for active acoustic compensation in one or several theaters. In some embodiments, this active acoustic compensation can be achieved via either masking or destructive interference. The system 100 can include a processor 102 which can include, for example, one or several processors or servers. The processor 102 can be any computing and/or processing device including, for example, one or several laptops, personal computers, tablets, smartphones, servers, mainframe computers, processors, or the like. The processor 102 can be configured to receive inputs from one or several other components of the system 100, to process the inputs according to one or several stored instructions, and to provide outputs to control the operation of one or several of the other components of the system 100.

The system 100 can include memory 106. The memory 106 can represent one or more storage media and/or memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, and/or various other storage mediums capable of storing that contain or carry instruction(s) and/or data. The memory 106 can be an integral part of the processor 102 and/or can be separate from the processor 102. In embodiments in which the memory 106 is separate from the processor 102, the memory 106 and the processor 102 can be communicatingly linked via, for example, communications network 130. In some embodiments, the communications network 130 can comprise any wired or wireless communication connection between the components of the simulation system 100.

The memory 106 can include software code and/or instructions for directing the operation of the processor 102 and/or one or several databases 106 containing information used by the processor 102 and/or generated by the processor 102. These databases include, for example, a content database 106-A, a filter database 106-B, and a compensation database 106-C.

The content database 106-A can include content for presentation in one or several theaters. In some embodiments, this content can comprise video content, audio content, combined video and audio content, or the like. This content can be in the form of one or several films, movies, shows, simulations, interactive stories, or video games. In some embodiments, this content can include a storyline, a plot, or narrative the may be static or that may be dynamic based on received user inputs. In some embodiments, the content database 106-A can include information identifying one or several acoustic events in the content. This information can identify the time within the content presentation of the occurrence of the one or several acoustic events. In some embodiments, this information in the content database can include attributes of those one or several acoustic events, which attributes can include, for example, the duration of one or several acoustic events, the volume of one or several acoustic events, the frequency or frequencies forming the one or several acoustic events, and/or the phase of sound waves forming the one or several acoustic events.

The filter database 106-B can include information relating to the transmission of sound and/or vibrations between theaters. In some embodiments, this information can be specific to a pair of theaters such as, for example, the pair including the first theater and the second theater, and in some embodiments, this information can be generic. The information relating to the transmission of sound and/or vibrations between theaters can, for example, specify transmission losses to sound and/or vibrational waves moving between theaters, and can specifically characterize the degree of sound and/or vibrational dampening occurring between theaters, phase shift in sound and/or vibrational waves of the acoustic event occurring between theaters, change in the frequency of the acoustic event between theaters, or the like. In some embodiments, this information can be stored in one or several filter values within the filter database 106-B.

The compensation database 106-C can include information identifying one or several compensating acoustic events and/or associated video events or visual events. In some embodiments, a compensating acoustic event can be an acoustic event selected and/or generated to decrease the detectability of sound and/or vibrations coming from another theater. This compensating acoustic event can compensate for the sound and/or vibrations from the other theater by, for example, masking the sound and/or vibrations from the other theater, or mitigating the sound and/or vibrations from the other theater via, for example, destructive interference. This acoustic event and the accompanying visual event can be integrated into the narrative which can include content presented before the acoustic event and content presented after the acoustic event.

The system 100 can include a plurality of theaters 108, which can include, a first theater 108-A, a second theater 108-B, and up to an $N^{th}$ theater, 108-N. The theaters 108 can be any room or area in which content can be provided to a content consumer. The theaters 108 can include, for example, one or several movie theaters, one or several amusement rides, or the like. The theaters 108 can each include a content presentation system 110 such that the first theater 108-A includes a first content presentation system 110-A, the second theater 108-B includes a second content presentation system 110-B, and the $N^{th}$ theater 108-N includes an $N^{th}$ content presentation system 110-N.

The content presentation system 110 of the theaters 108 can provide and/or present audio content via the audio presentation system 112 and/or video content via the video presentation system 114. Specifically, the audio presentation system 112 can include a first audio presentation system 112-A in the first theater 108-A and second audio presentation system 112-B in the second theater 108-B. Similarly, the video presentation system 114 can include a first video presentation system 114-A in the first theater 108-A and a second video presentation system 114-B in the second theater 108-B.

III. Sound Transmission Between Theaters

Figure 2:
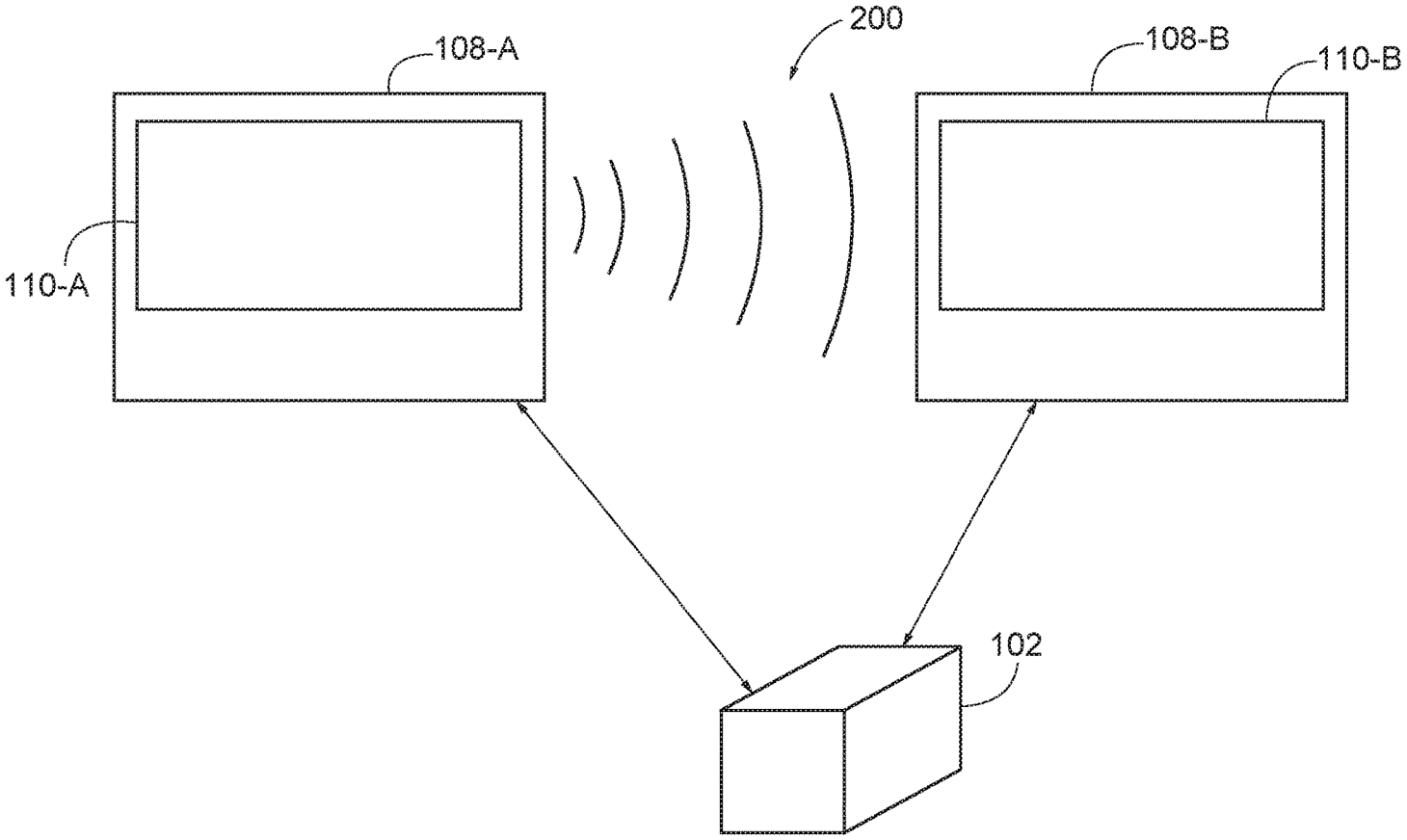
FIG. 2 is a schematic illustration of one embodiment of a first acoustic event affecting a second theater.

With reference now to FIG. 2, a schematic illustration of one embodiment of a first acoustic event affecting a second theater is shown, and specifically one embodiment of sound and/or vibration transmission between theaters 108 is shown. As seen in FIG. 1, the first theater 108-A is proximate to the second theater 108-B. The first theater 108-A includes the first content presentation system 110-A and the second theater 108-B includes the second content presentation system 110-B.

Each of the first and second theaters 108-A, 108-B, and specifically each of the first and second content presentation systems 110-A, 110-B, is communicatingly connected to the processor 102. The processor 102 controls and/or can control the first and second content presentation systems 110-A, 110-B. Specifically, the processor can direct the first content presentation system 110-A to present first content in the first theater 108-A and can direct the second content presentation system 110-B to present second content in the second theater 108-B.

During the presentation of the first content in the first theater 108-A, a first acoustic event is generated. Specifically, the processor 102 controls the first content presentation system 110-A to generate sound and/or vibrations associated with a first acoustic event. The sound and/or vibrations generated by the first acoustic event travels to the second theater 108-B via sound and/or vibration waves 200. If the sound and/or vibrations generated by the first acoustic event is sufficiently loud, then the sound and/or vibrations can interfere with the presentation of content in the second theater 108-B.

IV. Active Acoustic Compensation

Figure 3:
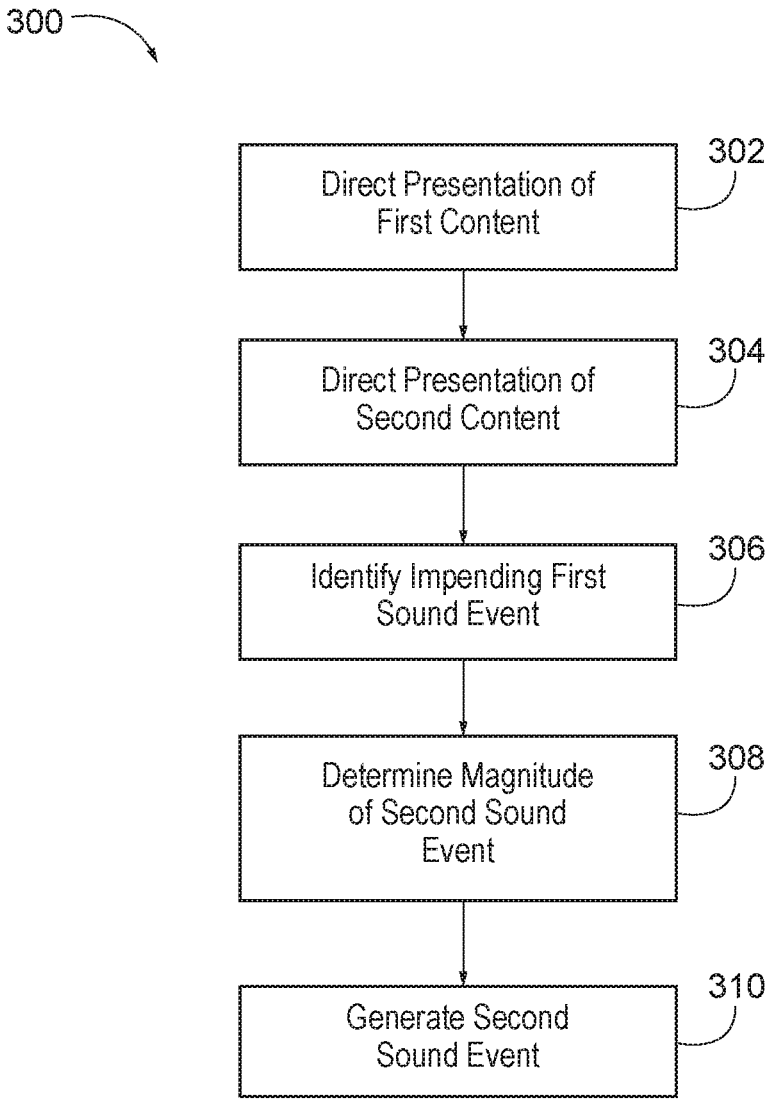
FIG. 3 is a flowchart illustrating one embodiment of a process for active acoustic compensation in proximate theaters.

With reference now to FIG. 3, a flowchart illustrating one embodiment of a process 300 for active acoustic compensation is shown. The process 300 can be performed by all or portions of the active acoustic compensation system 100, and specifically can be performed by the server 102. In some embodiments, the process 300 can include the controlling of content presentation systems 110 in the first theater 108-A and in the second theater 108-B so as to identify and mitigate acoustic events that will occur in one of the theaters 108-A, 108-B and impact the other of the theaters 108-A, 108-B.

The process 300 begins at block 302 wherein presentation of first content in the first theater 108-A is directed. In some embodiments, this step can include the generation and sending of one or several control signals from the processor 102 to the first theater 108-A, and specifically to the first content presentation system 110-A of the first theater 108-A. In some embodiments, for example, the processor 102 can retrieve information from the memory 106, and specifically from the content database 106-A. This information can include all or portions of the first content including, for example, data relating to one or several acoustic events included in the content. The processor 102 can then provide all or portions of the first content to the first theater 108-A and/or to the first content presentation system 110-A via the network 130.

At block 304 of process 300, presentation of second content in the second theater 108-B is directed. In some embodiments, this step can include the generation and sending of one or several control signals from the processor 102 to the second theater 108-B, and specifically to the second content presentation system 110-B of the second theater 108-B. In some embodiments, for example, the processor 102 can retrieve information from the memory 106, and specifically from the content database 106-A. This information can include all or portions of the second content including, for example, data relating to one or several acoustic events included in the second content. The processor 102 can then provide all or portions of the second content to the second theater 108-B and/or to the second content presentation system 110-B via the network 130.

At block 306 of the process 300 an impending first acoustic event is identified. In some embodiments, the impending first acoustic event can occur in the first content presented in the first theater 108-B. In some embodiments, the first acoustic event can be one or several sounds and/or vibrations identified as affecting viewing in other theaters 108, and, in some embodiments, an acoustic event can be impending when it is set to occur within the next 10 minutes, within the next 5 minutes, within the next 1 minute, within the next 45 seconds, within the next 30 seconds, within the next 15 seconds, within the next 5 seconds, or within the next 1 second. In some embodiments, one or several sounds and/or vibrations can be identified as an acoustic event based on, for example, a volume of these one or several sounds and/or vibrations exceeding a volume threshold. This comparison between the volume of one or several sounds and/or vibrations to a volume threshold can be performed simultaneous with the presentation of content as described in block 302, or can be performed before the presentation of content as described in block 302. In some embodiments, for example, this comparison can be performed in advance of the presentation of content as described in block 302 and the result of this comparison can be stored in the memory 106 and specifically within the content database 106-A.

In some embodiments, an acoustic event can be identified within the content database 106-A and be associated with the content of which the acoustic event is a part. In some embodiments, the designation of an acoustic event within the content database 106-A can include the association of one or several values with one or several sounds and/or vibrations and/or the storing of one or several values associated with one or several sounds and/or vibrations in the content database 106-A. In some embodiments in which the acoustic event is designated within the content database 106-A, the identification of an impending first acoustic event can include the determination of the presence of one or several values designating one or several sounds and/or vibrations as an acoustic event. This determination can be made by the processor 102.

At block 308 of the process 300, the magnitude of a second acoustic event is determined. In some embodiments, this can include determining one or several properties of the second acoustic event to mitigate the effect of the first acoustic event on content consumers in the second theater 108-B. In some embodiments, this can include selecting a volume of the second acoustic event, a frequency of the second acoustic event, a phase of the second acoustic event, and/or a duration of the second acoustic event to mask the first acoustic event and/or destructively interfere with the first acoustic event. In some embodiments, the magnitude of the second acoustic event can be determined based on the magnitude of the first acoustic event. The magnitude of the second acoustic event can be determined by the processor 102.

At block 310 of the process 300, the second acoustic event is generated. In some embodiments, this can include the directing of the generation of the second acoustic event by the processor 102. This can include the generation and sending of one or several control signals from the processor 102 to the second theater 108-B, and specifically to the second content presentation system 110-B, which one or several control signals cause the generation of the second acoustic event. In some embodiments, the second acoustic event can be generated at the same time as the generation of the first acoustic event and/or at the time the first acoustic event is heard in the second theater 108-B, and in some embodiments, the second acoustic event can be generated to be at least partially coinciding with the first acoustic event, such that the second acoustic event mitigates the detectability of the first acoustic event in the second theater 108-B.

In embodiments in which the presented content comprises static content that does not change based on user inputs, the generation of the second acoustic event can include the modification of one or several existing sounds and/or vibrations within the content being presented in the second theater 108-B. This can include, for example, the increasing of the volume of one or several sounds and/or vibrations in the second theater to mask the sound and/or vibrations from the first theater, or the changing of the frequency of one or several sounds and/or vibrations in the second theater. In embodiments in which the presented content comprises dynamic content, the generation of the second acoustic event can include the addition of one or several second acoustic event, and in some embodiments, associated video content to the content being presented in the second theater 108-B.

Figure 4:
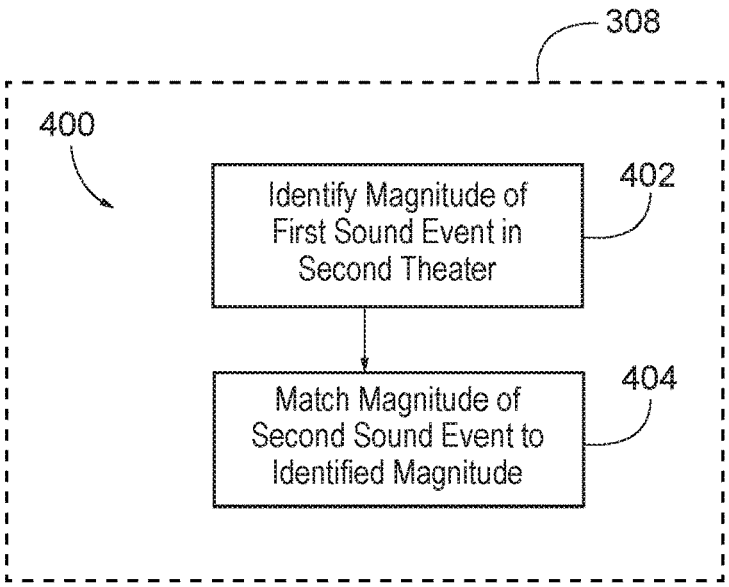
FIG. 4 is a flowchart illustrating one embodiment of a process for determining a magnitude of a second acoustic event.

With reference now to FIG. 4, a flowchart illustrating one embodiment of a process 400 for determining a magnitude of the second acoustic event is shown. The process 400 can be performed as a part of, or in the place of step 308 of FIG. 3. The process 400 can be performed by all or portions of the active acoustic compensation system 100, and specifically can be performed by the server 102. The process 400 begins a block 402 wherein the magnitude of the first acoustic event in the second theater 108-B is determined. This magnitude of the first acoustic event in the second theater 108-B can characterize, for example, the volume of the first acoustic event in the second theater 108-B, the duration of the first acoustic event in the second theater 108-B, or the frequency of the first acoustic event in the second theater 108-B. In some embodiments, this determination can be based off of information retrieved from the content database 106-A relating to the first acoustic event.

After the magnitude of the first acoustic event in the second theater 108-B has been determined, the process 400 proceeds to block 404 wherein a magnitude of the second acoustic event is matched to the identified magnitude of the first acoustic event in the second theater. In some embodiments, this can include selecting a second acoustic event from the event database 106-C that has magnitude equal to the magnitude of the first acoustic event in the second theater 108-B or that has a magnitude greater than the magnitude of the first acoustic event in the second theater 108-B. In some embodiments, matching the magnitude of the second acoustic event to the identified magnitude can include the modification of the magnitude of a second acoustic event so that the magnitude of the second acoustic event is greater than or equal to the magnitude of the first acoustic event in the second theater 108-B. The matching of the magnitude of the second acoustic event to the identified magnitude of the first acoustic event in the second theater 108-B can be performed by the processor 102.

After the magnitude of the second acoustic event has been matched to the identified magnitude of the first acoustic event in the second theater 108-B, the process 400 can advance to block 310 of the process 300 shown in FIG. 3. In such an embodiment, the process 300 can then proceed as outlined above.

Figure 5:
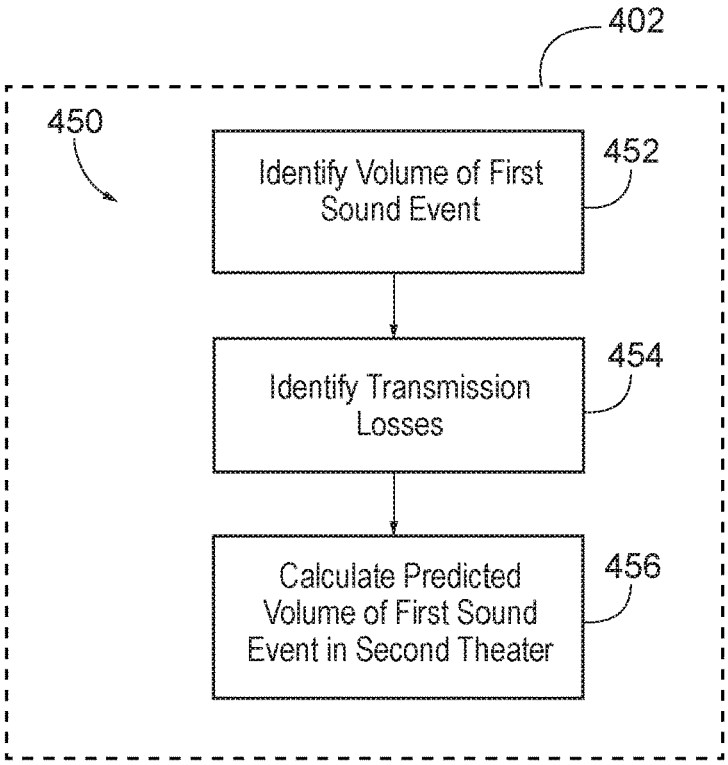
FIG. 5 is a flowchart illustrating one embodiment of a process for identifying a magnitude of a first acoustic event in a second theater.

With reference now to FIG. 5, a flowchart illustrating one embodiment of a process 450 for identifying the magnitude of the first acoustic event in the second theater 108-B is shown. The process 450 can be performed as a part of, or in the place of step 402 of FIG. 4. The process 450 can be performed by all or portions of the active acoustic compensation system 100, and specifically can be performed by the server 102.

The process 450 begins at block 452 wherein the volume of the first acoustic event is identified. In some embodiments, this volume can be the volume of the first acoustic event in the first theater 108-A. The volume of the first acoustic event can be determined based on information stored in the memory 106 and specifically in the content database 106-A. This information stored in the memory 106 or in the content database 106-A can, in some embodiments, be used to generate the first acoustic event. In some embodiments, information specifying the volume in the memory 106 or in the content database 106-A can, for example, specify an amplitude of acoustic waves forming the first acoustic event, a decibel level of the first acoustic event, a power consumption level of the first audio presentation system 112-A to generate the first acoustic event, and/or a normalized value indicative of the volume of the first acoustic event. In embodiments in which information specifying the volume of the first acoustic event is contained in the memory 106 and specifically in the content database 106-A, identifying the volume of the first acoustic event can include retrieving this information from the memory 106 and/or the content database 106-A with the server 102.

After the volume of the first acoustic event has been identified, the process 450 proceeds to block 454 wherein one or several transmission losses are identified. In some embodiments, the transmission losses can specify or indicate the dampening or degree of dampening of sounds and/or vibrations traveling from the first theater 108-A to the second theater 108-B. In some embodiments the transmission losses can be identified via one or several values which can be stored in the memory 106 and specifically in the filter database 106-B. These one or several values can indicate, for example, a degree to which the volume of a sound and/or vibration decreases when traveling from the first theater 108-A to the second theater 108-B, or the number of decibels lost in transmission of a sound and/or vibration from the first theater 108-A to the second theater 108-B. In some embodiments, the identification of transmission losses in step 454 can include the retrieval of these one or several values from the memory 106 and specifically from the filter database 106-B by the server 102.

After the transmission losses have been identified, the process 450 proceeds to block 456 wherein a predicted volume or amplitude of the first acoustic event in the second theater 108-B is identified, or in some embodiments, is calculated. The identification of the predicted volume of the first acoustic event in the second theater 108-B can include the application of the transmission losses identified in block 454 to the volume of the first acoustic event identified in block 452. This can include, for example, performing one or several mathematical operations on the identified volume of the first acoustic event based on the one or several values characterizing transmission losses of sound and/or vibration from the first theater 108-A to the second theater 108-B. These operations can include, for example, multiplying or dividing the identified volume by the one or several values characterizing transmission losses, or subtracting the one or several values characterizing transmission losses from the identified volume.

After the predicted volume of the first acoustic event in the second theater 108-B has been calculated, the process 450 can advance to block 404 of the process 400 shown in FIG. 4. In such an embodiment, the process 400 can then proceed as outlined above.

Figure 6:
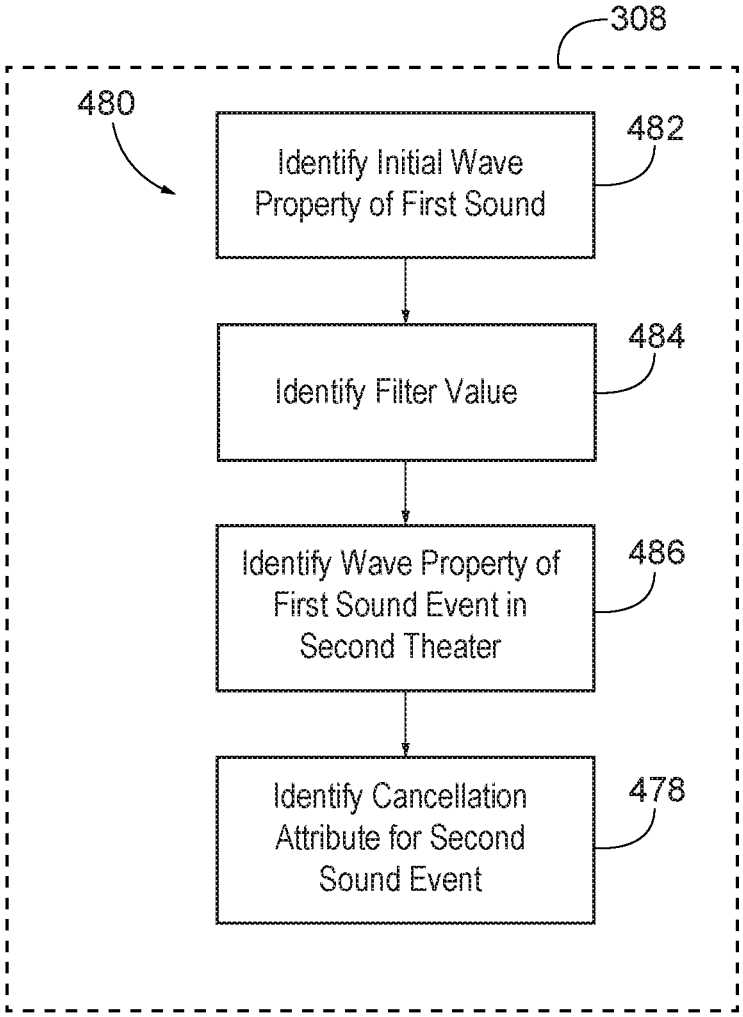
FIG. 6 is a flowchart illustrating one embodiment of another process for determining a magnitude of a second acoustic event.

With reference now to FIG. 6, a flowchart illustrating another embodiment of a process 470 for determining a magnitude of the second acoustic event is shown. The process 470 can be performed as a part of, or in the place of step 308 of FIG. 3. The process 470 can be performed by all or portions of the active acoustic compensation system 100, and specifically can be performed by the server 102. The process 470 begins a block 472 an initial attribute of the first acoustic event is identified and/or determined. This initial attribute can be an attribute, which can be an initial wave property, of the first acoustic event in the first theater 108-A and can include, for example, an amplitude, a volume, a frequency, and/or a phase. The attribute of the first acoustic event can be determined based on information stored in the memory 106 and specifically in the content database 106-A, which information can, in some embodiments, be used to generate the first acoustic event. In embodiments in which information specifying the attribute of the first acoustic event is contained in the memory 106 and specifically in the content database 106-A, identifying the attribute of the first acoustic event can include retrieving this information from the memory 106 and/or the content database 106-A with the server 102.

After the attribute of the first acoustic event has been identified, the process 470 proceeds to block 474 wherein a filter value is identified. In some embodiments, the filter value can specify or indicate how, or the degree to which one or several attributes of sounds and/or vibrations traveling from the first theater 108-A to the second theater 108-B change. In some embodiments the filter value can comprise one or several values which can be stored in the memory 106 and specifically in the filter database 106-B. These one or several values can indicate, for example, how or the degree to which some or all of the attributes of the first acoustic event change while traveling from the first theater 108-A to the second theater 108-B, including, for example, how or the degree to which the frequency, the amplitude, the volume, or the phase of the sound and/or vibration change while traveling from the first theater 108-A to the second theater 108-B. In some embodiments, the identification of filter value in step 484 can include the retrieval of these one or several values from the memory 106 and specifically from the filter database 106-B by the server 102.

After the filter value has been identified, the process 470 proceeds to block 476 wherein a predicted attribute, which can be one or several wave properties, of the first acoustic event in the second theater 108-B is identified or, in some embodiments, is calculated. In some embodiments, the identification of the predicted attribute of the first acoustic event in the second theater 108-B can include the application of the filter value identified in block 474 to the attribute of the first acoustic event identified in block 472. This can include, for example, performing one or several mathematical operations on the one or several identified attributes of the first acoustic event based on the one or several filter values. These operations and/or the identification or calculation of the attributes of the first acoustic event in the second theater 108-B can be performed by the processor 102.

After the identification of the one or several attributes of the first acoustic event in the second theater 108-B, the process 470 proceeds to block 478, wherein a cancellation attribute for the second acoustic event is identified. The identification of the cancellation attribute can be based on the identified attribute of the first acoustic event in the second theater 108-B determined in block 476. In some embodiments, the identification of the cancellation attribute can include identification a second acoustic event from the event database 106-C that has one or several attributes such that, when generated, the second acoustic event destructively interferes with the first acoustic event in the second theater 108-B. In some embodiments, this can include selecting a second acoustic event having the same or similar frequency to the first acoustic event or to the attribute identified in block 476, an opposite phase to the phase of the first acoustic event or to the attribute identified in block 476, and in some embodiments, a desired volume or amplitude. In some embodiments, this desired volume or amplitude can be equal to the volume or amplitude of the first acoustic event in the second theater 108-B, and in some embodiments, this volume or amplitude can be less than or greater than the volume or amplitude of the first acoustic event in the second theater 108-B. In some embodiments, identifying the cancellation attribute for the second acoustic event can include the modification of one or several attributes of a second acoustic event so that destructive interference between the second acoustic event and the first acoustic event in the second theater 108-B is maximized. This can include, for example, modifying the frequency of the second acoustic event, modifying the volume or amplitude of the second acoustic event, or modifying the phase of the second acoustic event. The identifying of the cancellation attribute for the second acoustic event in the second theater 108-B can be performed by the processor 102.

After the cancellation attribute for the second acoustic event has been identified, the process 470 can advance to block 310 of the process 300 shown in FIG. 3. In such an embodiment, the process 300 can then proceed as outlined above.

V. Computer System

Figure 7:
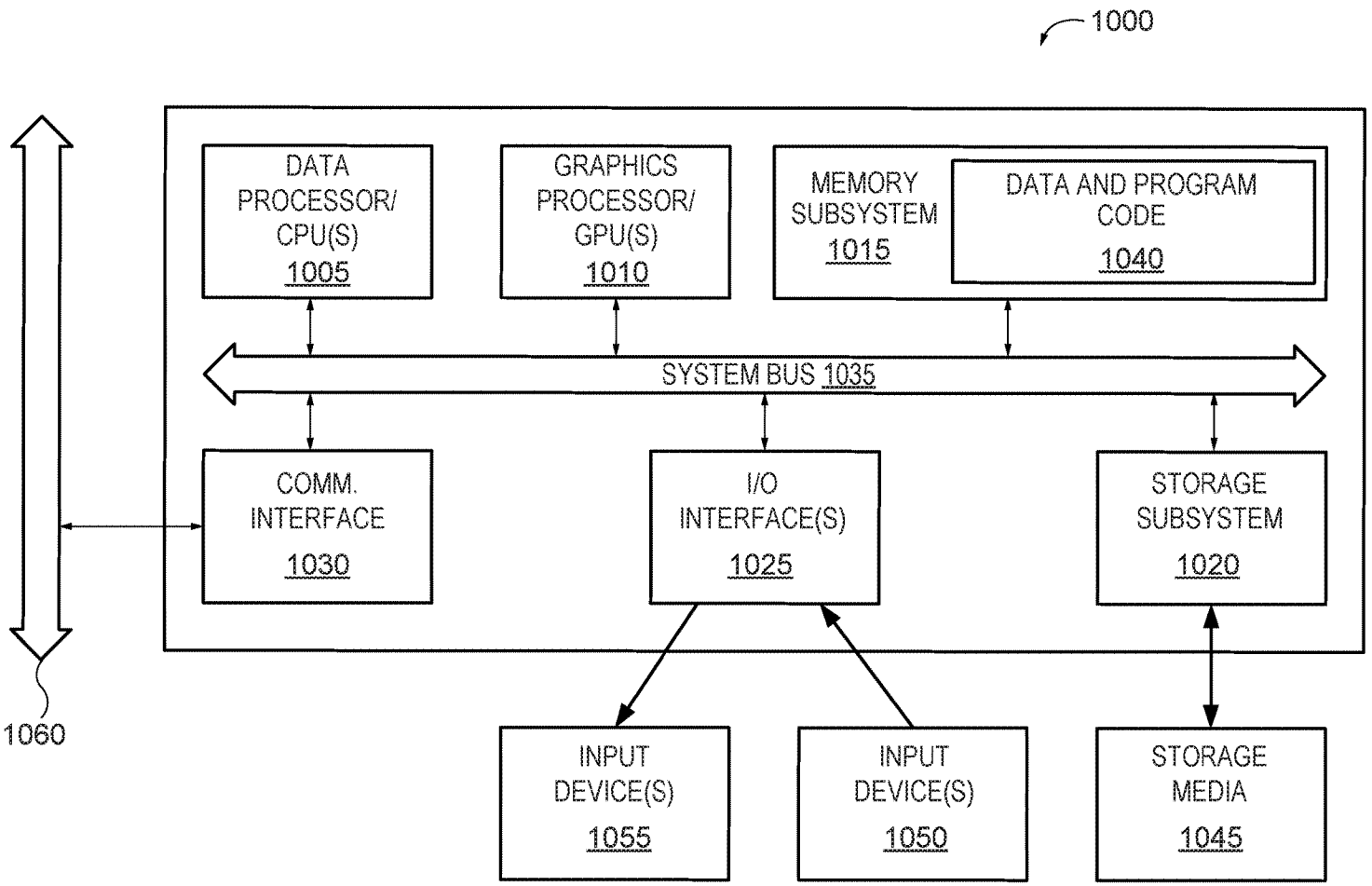
FIG. 7 is a block diagram of a computer system or information processing device that may incorporate an embodiment, be incorporated into an embodiment, or be used to practice any of the innovations, embodiments, and/or examples found within this disclosure.

FIG. 7 shows a block diagram of computer system 1000 that is an exemplary embodiment of the processor 102 and can be used to implement methods and processes disclosed herein. FIG. 7 is merely illustrative. Computer system 1000 may include familiar computer components, such as one or more one or more data processors or central processing units (CPUs) 1005, one or more graphics processors or graphical processing units (GPUs) 1010, memory subsystem 1015, storage subsystem 1020, one or more input/output (I/O) interfaces 1025, communications interface 1030, or the like. Computer system 1000 can include system bus 1035 interconnecting the above components and providing functionality, such connectivity and inter-device communication.

The one or more data processors or central processing units (CPUs) 1005 execute program code to implement the processes described herein. The one or more graphics processor or graphical processing units (GPUs) 1010 execute logic or program code associated with graphics or for providing graphics-specific functionality. Memory subsystem 1015 can store information, e.g., using machine-readable articles, information storage devices, or computer-readable storage media. Storage subsystem 1020 can also store information using machine-readable articles, information storage devices, or computer-readable storage media. Storage subsystem 1020 may store information using storage media 1045 that can be any desired storage media.

The one or more input/output (I/O) interfaces 1025 can perform I/O operations and the one or more output devices 1055 can output information to one or more destinations for computer system 1000. One or more input devices 1050 and/or one or more output devices 1055 may be communicatively coupled to the one or more I/O interfaces 1025. The one or more input devices 1050 can receive information from one or more sources for computer system 1000. The one or more output devices 1055 may allow a user of computer system 1000 to view objects, icons, text, user interface widgets, or other user interface elements.

Communications interface 1030 can perform communications operations, including sending and receiving data. Communications interface 1030 may be coupled to communications network/external bus 1060, such as a computer network, a USB hub, or the like. A computer system can include a plurality of the same components or subsystems, e.g., connected together by communications interface 1030 or by an internal interface.

Computer system 1000 may also include one or more applications (e.g., software components or functions) to be executed by a processor to execute, perform, or otherwise implement techniques disclosed herein. These applications may be embodied as data and program code 1040. Such applications may also be encoded and transmitted using carrier signals adapted for transmission via wired, optical, and/or wireless networks conforming to a variety of protocols, including the Internet.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A system for active acoustic compensation in proximate theaters, the system comprising:

a first theater comprising a first content presentation system;

a second theater comprising a second content presentation system;

a processor in communicating connection with the first content presentation system and the second content presentation system, wherein the processor is configured to:

direct presentation of first content in the first theater via the first content presentation system;

direct presentation of second content in the second theater via the second content presentation system;

identify an acoustic event as a first acoustic event, wherein the first acoustic event is impending in the first theater, wherein the first acoustic event has a level sufficient to be detectable in the second theater; and control the second content presentation system to generate a second acoustic event at least partially coinciding with the first acoustic event, wherein the second acoustic event mitigates the detectability of the first acoustic event in the second theater.

2. The system of claim 1, wherein controlling the second content presentation system to generate a second acoustic event comprises controlling the second content presentation system to generate a second visual event corresponding the second acoustic event, and wherein the second acoustic event and the second visual event are integrated into a narrative formed by content presented before and after the second acoustic event and the second visual event.

3. The system of claim 1, wherein the second acoustic event masks the first acoustic event.

4. The system of claim 1, wherein the second acoustic event mitigates the first acoustic event via destructive cancellation.

5. The system of claim 1, wherein mitigating the detectability of the first acoustic event in the second theater comprising determining a magnitude of the second acoustic event.

6. The system of claim 5, wherein determining the magnitude of second acoustic event comprises:

identifying the magnitude of the first acoustic event in the second theater; and matching the magnitude of the second acoustic event to the identified magnitude of the first acoustic event.

7. The system of claim 6, wherein identifying the magnitude of the first acoustic event in the second theater comprises: identifying an amplitude of the first acoustic event in the first theater; identifying transmission losses from the first theater to the second theater; and calculating the amplitude of the first acoustic event in the second theater based on the identified amplitude of the first acoustic event in the first theater and the transmission losses.

8. The system of claim 7, wherein identifying the amplitude of the first acoustic event in the first theater comprises retrieving data for generating the first acoustic event from a memory, wherein the data characterizes the amplitude of the first acoustic event in the first theater.

9. The system of claim 5, wherein determining the magnitude of second acoustic event comprises: identifying an attribute of the first acoustic event in the second theater; and identifying a cancellation attribute for the second acoustic event in the second theater.

10. The system of claim 9, wherein identifying the cancellation attribute comprises: identifying at least one initial wave property of the first acoustic event in the first theater; identifying a filter value affecting acoustic transmission from the first theater to the second theater; and calculating at least one wave property of the first acoustic event in the second theater based on the at least one initial wave property and the filter value.

11. The system of claim 10, wherein the at least one wave property comprises at least one of: a frequency; a phase; and an amplitude.

12. A method for active acoustic compensation in proximate theaters, the method comprising:

directing presentation of first content in a first theater via a first content presentation system;

directing presentation of second content in a second theater via a second content presentation system;

identifying an acoustic event as a first acoustic event, wherein the first acoustic event is impending in the first theater, wherein the first acoustic event has a level sufficient to be detectable in the second theater; and controlling the second content presentation system to generate a second acoustic event at least partially coinciding with the first acoustic event, wherein the second acoustic event mitigates the detectability of the first acoustic event in the second theater.

13. The method of claim 12, wherein the second acoustic event masks the first acoustic event.

14. The method of claim 12, wherein directing presentation of second content in the second theater via the second content presentation system comprises controlling the second content presentation system to present video and audio content forming a narrative, wherein controlling the second content presentation system to generate a second acoustic event comprises controlling the second content presentation system to generate a second visual event corresponding the second acoustic event, and wherein the second acoustic event and the second visual event generated are integrated into the narrative.

15. The method of claim 12, wherein the second acoustic event mitigates the first acoustic event via destructive cancellation.

16. The method of claim 12, wherein mitigating the detectability of the first acoustic event in the second theater comprises determining a magnitude of the second acoustic event.

17. The method of claim 16, wherein determining the magnitude of second acoustic event comprises:

identifying the magnitude of the first acoustic event in the second theater; and matching the magnitude of the second acoustic event to the identified magnitude of the first acoustic event.

18. The method of claim 17, wherein identifying the magnitude of the first acoustic event in the second theater comprises: identifying an amplitude of the first acoustic event in the first theater; identifying transmission losses from the first theater to the second theater; and calculating the amplitude of the first acoustic event in the second theater based on the identified amplitude of the first acoustic event in the first theater and the transmission losses.

19. The method of claim 18, wherein identifying the amplitude of the first acoustic event in the first theater comprises retrieving data for generating the first acoustic event from a memory, wherein the data characterizes the amplitude of the first acoustic event in the first theater.

20. The method of claim 17, wherein determining the magnitude of second acoustic event comprises: identifying an attribute of the first acoustic event in the second theater; and identifying a cancellation attribute for the second acoustic event in the second theater.

21. The method of claim 20, wherein identifying the cancellation attribute comprises: identifying at least one initial wave property of the first acoustic event in the first theater; identifying a filter value affecting acoustic transmission from the first theater to the second theater; and calculating at least one wave property of the first acoustic event in the second theater based on the at least one initial wave property and the filter value.

22. The method of claim 21, wherein the at least one wave property comprises at least one of: a frequency; a phase; and an amplitude.

* * * * *